US005492075A

United States Patent [19]

Lerstad et al.

[11] Patent Number: 5,492,075

[45] Date of Patent: Feb. 20, 1996

[54] METHOD FOR OFFSHORE LOADING OF A TANKER AND CONSTRUCTION OF SAID TANKER

[75] Inventors: Arve Lerstad, Sandnes; Kare Breivik, Tau; Trygve G. Egge, Hafrsfjord; Arne Smedal, Færvik; Ole Overli, Sandnes, all of Norway

[73] Assignee: Den Norske Stats Oljeselskap A.S., Stavanger, Norway

[21] Appl. No.: 356,209

[22] PCT Filed: Jun. 11, 1993

[86] PCT No.: PCT/NO93/00090

§ 371 Date: Jan. 26, 1995

§ 102(e) Date: Jan. 26, 1995

[87] PCT Pub. No.: WO93/25433

PCT Pub. Date: Dec. 23, 1993

[30] Foreign Application Priority Data

Jun. 15, 1992 [NO] Norway ..... 922352

[51] Int. Cl.[6] ..... B63B 25/08

[52] U.S. Cl. ..... 114/74 R

[58] Field of Search ..... 114/65 R, 72, 114/73, 74 R, 74 T, 74 A

[56] References Cited

U.S. PATENT DOCUMENTS 2,321,811 6/1943 Harris ..... 114/74 R 3,766,875 10/1973 Baki ..... 114/74 R 3,926,135 12/1975 De Gregorio ..... 114/74 R

*Primary Examiner*—Stephen Avila

*Attorney, Agent, or Firm*—Scully, Scott, Murphy & Presser

[57] ABSTRACT

A method and a vessel for offshore oil loading, wherein the vessel comprises a number of center tanks (3) arranged in the longitudinal direction of the vessel, and a number of wing tanks (5, 6) located in pairs on either side of respective center tanks, a loading line (19) being connected to the center tanks (3) via respective valves (20), and adjacent center tanks (3) being connected to each other via bulkhead valves (18). The method comprises the steps of a) firstly effecting filling of a desired number of the center tanks (3), these being substantially narrower and having a correspondingly smaller volume than the wing tanks (5, 6), b) thereafter opening bulkhead valves (17) between a center tank (3) and an appurtenant wing tank pair (5, 6), and sluicing out oil from the center tanks (3) into the two wing tanks (5, 6) by means of the static pressure from the center tanks, the bulkhead valves (18) between the center tanks (3) being open, so that the wing tank pair (5, 6) is filled as quickly as possible by suitable operation of the bulkhead valves (18) between the center tanks (3) and of the valves (20) of the loading line (19) to the center tanks (3), c) closing the bulkhead valves (17) of the two wing tanks (5, 6) when these and the appurtenant center tank (3) are filled to a desired level, and d) repeating the filling process according to the steps b) and c) successively for additional wing tank pairs (5, 6) after that all center tanks (3) have been filled again.

11 Claims, 3 Drawing Sheets

METHOD FOR OFFSHORE LOADING OF A TANKER AND CONSTRUCTION OF SAID TANKER

The invention relates to a method and a vessel for offshore oil loading, wherein the vessel comprises a number of center tanks arranged in the longitudinal direction of the vessel, and a number of wing tanks located in pairs on either side of respective center tanks, a loading line being connected to the center tanks via respective valves, and adjacent center tanks being connected to each other via bulkhead valves.

In connection with offshore oil loading a part of the load will be lost to the atmosphere because of de-gassing from the liquid surface. As an example, in a typical buoy loading in the North Sea, there may be lost approximately 200 tons per loading of tankers of about 120 000 tons. The release of gas mainly is due to splashing and stirring of crude oil in the loading tanks, and occurring pressure drop in the hydrocarbon load during the handling thereof.

Measurements have shown that the extent of the degassing is proportional to the time before the tanks are full, and the period of the condition of standing waves (resonance) in the tanks. In addition, loads on the tank structure will be increasing with the period of standing waves. It is therefore essential to fill the individual tanks as quickly as possible, both to reduce the de-gassing period and therewith the total spill of gases, and to reduce loads on the tank structures during loading.

Thus, the object of the invention is to provide a method and a vessel resulting in a substantial reduction of the degassing during loading, and also in a substantial reduction of loads on the tank structures.

It is also an object of the invention to provide a vessel having a tank arrangement which has technical and economic advantages, especially with direct loading of tankers on the field.

For the achievement of the above-mentioned objects there is provided a method of the introductorily stated type which, according to the invention, is characterized by the steps of a) firstly effecting filling of a desired number of the center tanks, these being substantially narrower and having a correspondingly smaller volume than the wing tanks, b) thereafter opening bulkhead valves between a center tank and an appurtenant wing tank pair and sluicing out oil from the center tanks into the two wing tanks by means of the static pressure from the center tanks, the bulkhead valves between the center tanks being open, so that the wing tank pair is filled as quickly as possible by suitable operation of the bulkhead valves between the center tanks and of the valves of the loading line to the center tanks, c) closing the bulkhead valves to the two wing tanks when these and the appurtenant center tank are filled to a desired level, and d) repeating the filling process according to the steps b) and c) successively for additional wing tank pairs after that all center tanks have been filled again.

According to the invention there is also provided a vessel of the introductorily stated type which, according to the invention, is characterized in that the center tanks have a width which is less than half the width of the wing tanks, that all tank triplets consisting of a center tank and an appurtenant wing tank pair are connected to each other via bulkhead valves, and that the loading line extends through the center tanks, all valves with appurtenant drive units being arranged centrally, in connection with the center tank area.

The invention will be further described below in connection with exemplary embodiments with reference to the drawings, wherein FIGS. 1, 2 and 3 show a side view, a plan view and a cross-section, respectively, of a vessel having a tank arrangement according to the invention;

Figure 1:
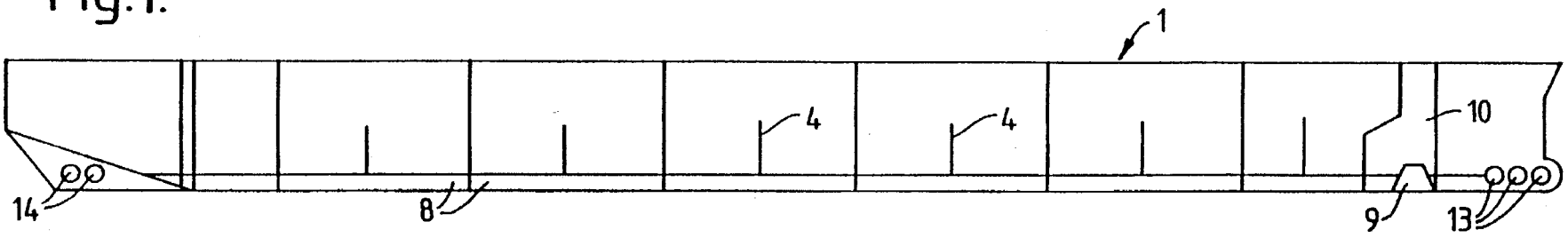
Figure 2:
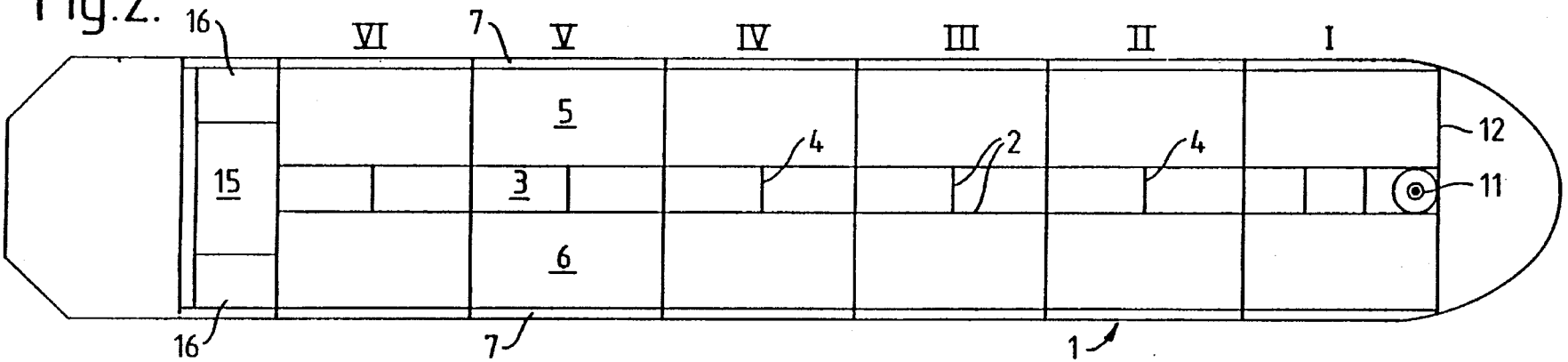

In the drawings there is shown a vessel 1 in the form of a tanker wherein a pair of longitudinal bulkheads 2 are arranged so that the tank area of the vessel is divided into a narrow center tank section and a pair of relatively wide wing tank sections. In the illustrated embodiment six tank triplets I–VI are arranged in the longitudinal direction of the ship, each of the triplets consisting of a center tank 3 and a pair of wing tanks 5, 6 which are located on either side of the center tank. The center tanks 3 have a width which is about one third of the width of the wing tanks, so that if the width of the ship is b in the loading tank area, the center tank has a width of about 1/7 b, whereas the wing tanks have a width of about 3/7 b.

As shown, in the center tanks 3 there are arranged rolling bulkheads or baffle plates 4 running from side to side in the tanks and extending up to about half the tank height. These have the function to prevent formation of longitudinally extending, standing waves in the oil cargo. If necessary, such bulkheads may also be arranged in the wing tanks.

As shown, ballast tanks 7 are arranged around the loading tanks by means of double hulls, and also the bottom of the vessel is executed as a double bottom, for the formation of bottom ballast tanks 8. The ballast tanks may be filled with ballast for stabilization purposes, filled or emptied selectively for trimming, etc.

As a dimensioning example, the center tanks may have a width of about 6 m, the wing tanks a width of about 18 m, and the ballast tanks on each side a width of about 2 m, with a total ship width of about 46 m.

The vessel 1 is built as a buoy loading tanker, and for this purpose is provided with a submerged receiving space 9 in the bow portion of the vessel, for the reception of an adapted underwater buoy (not shown), and with a vertical shaft 10 extending between the receiving space and the deck of the vessel. A vessel for operation with such a buoy is described in the international patent application No. PCT/N092/00055.

The vessel may, however, also be an offshore storage tanker or a production vessel, oil loading according to the present invention equally well being able to take place on such vessels.

The receiving space 9 and the loading equipment 11 for the topical buoy in the illustrated embodiment are arranged behind a forward collision bulkhead 12. As an alternative, the receiving space, the loading equipment and said shaft may be arranged at least partly in front of the collision bulkhead.

The vessel is shown to be provided with three bow thrusters 13 and two stern thrusters 14.

Figure 4:
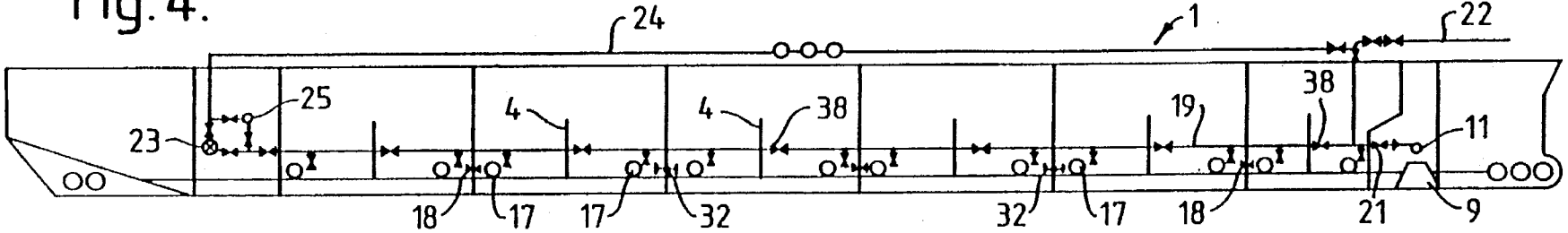
FIGS. 4 and 5 show a side view and plan view, respectively, of the vessel in FIGS. 1–3, and show the principal set-up of conduits and valves.
Figure 5:
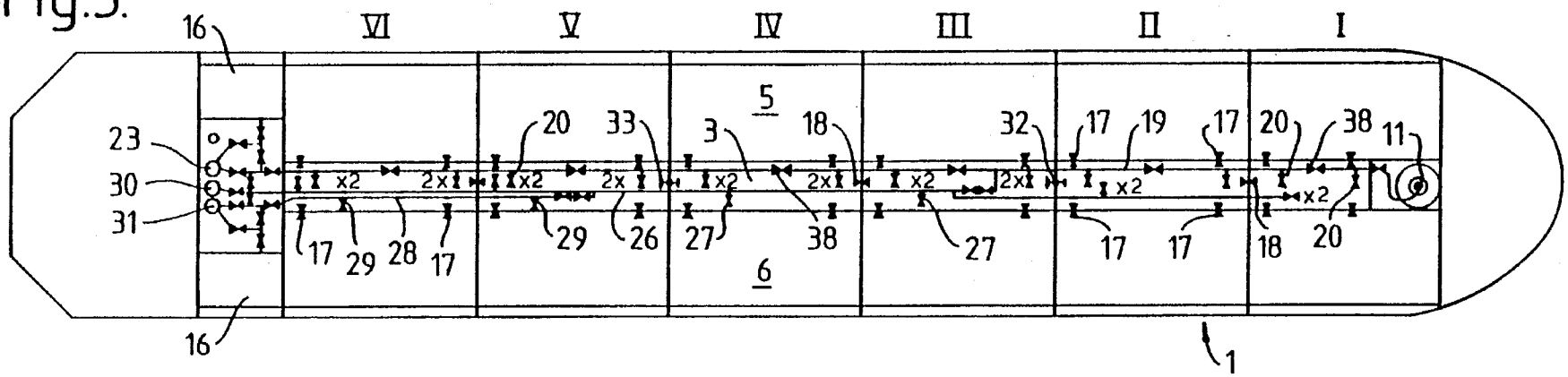

Behind the rearmost tank triplet VI there is arranged a pump room 15 for unloading pumps with an appurtenant pipe and valve arrangement, as shown in FIGS. 4 and 5. On each side of the pump room there is a slop or waste water tank 16.

Figure 3:
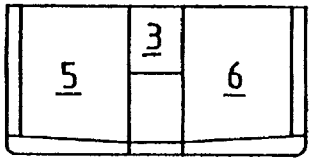
Figure 7:
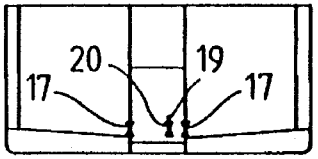
FIGS. 6 and 7 show cross-sections of two different bottom arrangements.
Figure 6:
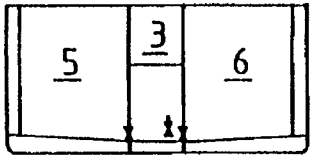

A typical ship cross-section is shown in FIG. 3. As shown, the wing tanks 5, 6 have a tilted bottom inwards towards the center tank 3, to secure a good flow to the center tank section when unloading. In order to obtain an additionally improved inflow from the wing tanks, the bottom of the center tanks may be located somewhat lower than the adjacent bottom area of the wing tanks, as shown in FIG. 7.

The conduit and valve arrangement for loading and unloading is shown in FIGS. 4 and 5.

In each tank triplet I–VI, the center tank 3 is connected to the pair of wing tanks 5, 6 by means of forward and rearward bulkhead valves 17. Further, all center tanks 3 are connected to each other through bulkhead valves 18. The bulkhead valves suitably may consist of "lying" flap valves, in order to have—in a simple manner—the valve opening placed as close to the bottom of the tank as possible. A typical size of the bulkhead valves is 500 mm in diameter.

A loading line or loading conduit 19 extends through all the center tanks 3 and is connected to the center tanks via respective loading line valves 20, so that the loading conduit or loading line is able to serve all the center tanks singly or collectively. On the loading line 19 there is also arranged pipe valves 38 in each of the center tanks 3. As shown, the loading line 19 extends as a bottom line through the center tanks, the loading line at its forward end being coupled directly to the loading equipment 11 for connection to the topical loading buoy in the receiving space 9, and at its rearward end being coupled to pumping and valve equipment in the pump room 15. As a result of the fact that the loading line along its entire length is located at the same level, underpressure during loading is avoided, and thereby transition from oil to gas in the pipe system, in the way it is typical in conventional offshore buoy loading, is prevented.

As shown in FIG. 4, the loading line 19 is coupled to the loading equipment 11 via at least one shut-off or stop valve 21. The loading line here is also coupled to a line or conduit 22 for traditional buoy loading.

In the pump room 15, the loading line 19 is coupled to a pump 23, through suitable valves. The pump is used in unloading of the tanks and is connected to an external unloading line 24. As shown, there is also arranged a so-called "cross-over" or transition connection 25, for the provision of an alternative pumping path, with a view to flexibility.

In addition to the loading line 19, the pipe arrangement in the illustrated embodiment comprises a pair of additional main pipes, more specifically a second conduit 26 which extends from the pump room 15 forwards to the center tank in the first tank triplet I and is connected to all center tanks via respective line valves 27, and a third conduit 28 which extends from the pump room 15 forwards to the center tank in the fifth tank triplet V and is connected to the center tanks in the tank triplets V and VI via line valves 29. These additional conduits 26 and 28 are connected to respective pumps 30 and 31 which are also coupled to external unloading lines. As shown, the conduits 19, 26 and 28 in the pump room are connected to each other and connected to the waste water tanks 16 via a suitable valve arrangement. The arrangement with the conduit 26 implies that there may also be pumped from the center tanks 3 into the tank triplet which is to be filled, as further described later.

For achieving a tripartite segregation of the tank area, double bulkhead valves 32 and 33 are arranged between the center tanks in the tank triplets II and III and the tank triplets IV and V, respectively. Moreover, the loading line 19 is provided with double valves in the center tanks in the tank triplets III–VI, and the conduit 26 is also provided with double valves in the center tanks in the tank triplets I, II, V and VI. A complete segregation for the tank triplets I and II, III and IV, and V and VI is then obtained. The loading line 19 then will serve the forward segregation, the conduit 26 will serve the intermediate segregation, and the conduit 28 will serve the rearward segregation.

As appears from the above, all conduits and all valves with appurtenant drive units are arranged in the central area, in connection with the center tanks. This gives a construction having relatively few pipes and valves, and thus reduced building costs and easier maintenance.

Figure 8:
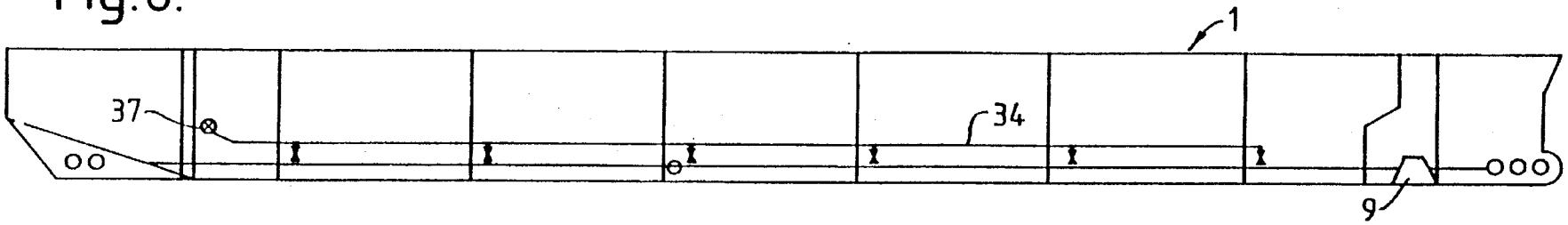
FIGS. 8, 9 and 10 are a side view, a plan view and a cross-section, respectively, showing a separate emergency loading or "stripping" arrangement which is also installed on the vessel.
Figure 9:
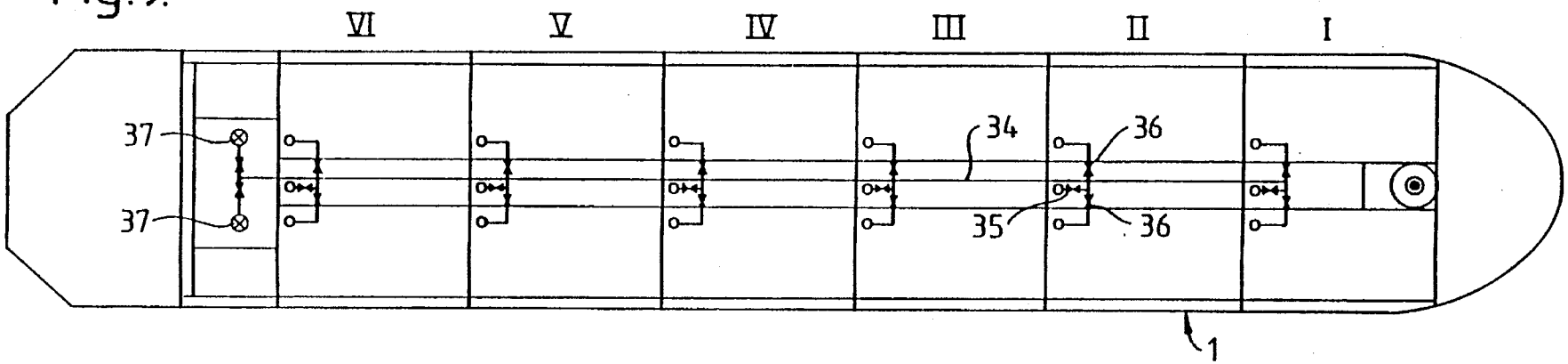
Figure 10:
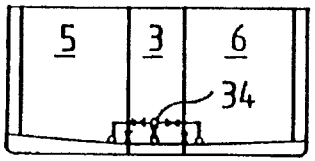

On the vessel there is also arranged a separate emergency unloading and/or stripping arrangement, as shown in FIGS. 8–10. This comprises a conduit 34 extending through all the center tanks 3 and being connected with separate outlets to each of the loading tanks 3, 5 and 6 via suitable valves 35 and 36. In the pump room 15, the conduit 34 is connected to double unloading pumps 37 leading to an external unloading line (not depicted).

All the three bottom lines 19, 26, 28 is connected to the stripping system. For this purpose double valves are provided (marked with the symbol "x2" in FIG. 5 in connection with the valves 20).

The main objective of the stripping arrangement is to drain all tanks completely. In addition, it will be able to be used for "emergency unloading" in the case of failure of bulkhead valves, and for transfer from one tank to another. The system may also be used for individual final filling of the tanks. The pipe arrangement will be provided with double valves in order to satisfy the demand for segregation with two valves.

In the following, the principal operations of the method according to the invention will be further described.

The principal procedure is that all center tanks are firstly filled, either collectively or singly, whereafter the bulkhead valves to a wing tank pair are opened, and these wing tanks are filled by means of the static pressure difference. By means of this loading procedure the relatively large wing tanks are filled as quickly as possible, and the time for the condition of standing waves in the tanks is reduced to a minimum.

As mentioned, a desired number, normally all, of the center tanks 3 are filled as a first step. In case of bad weather, with wind and sea, the center tanks are filled one by one, the bulkhead valves 18 being kept shut. In weather conditions giving small or little movement of the ship, the center tanks may be filled simultaneously, the bulkhead valves 18 between the center tanks being kept open.

When all the center tanks are full, all the bulkhead valves 18 therebetween are opened, if they are not already open. The loading line valves 20 to the center tanks 3 are shut, except to the center tank for the wing tank pair 5, 6 which is to be filled firstly, for example in tank triplet III or IV. The bulkhead valves 17 to these two wing tanks are opened, and the wing tanks then are filled as quickly as possible by means of the static pressure from the center tanks and the oil production from the loading line 19.

When the filling height of the wing tanks for standing waves has been passed, and the filling speed approaches the loading rate (i.e. the rate of flow of the oil production), the bulkhead valves 18 are closed between all the center tanks, whereas the loading line valve 20 to the tank triplet which is being filled, is kept open. The tank triplet then is filled quite up to the desired level for transport.

Thereafter the bulkhead valves 17 to the wing tanks are closed, and the loading line valve 20 to the appurtenant center tank is closed, at the same time as the loading line valves 20 to the next center tank to be filled, are opened.

The procedure is repeated when all the center tanks have been filled up again.

By means of the double conduit arrangement 19 and 26, filling of a tank triplet as an alternative may be carried out by means of the unloading pumps 23, 30, 31. In this operation all the valves 20 on the conduit 19 are closed, except for the valves at the front and rear edge of the center tank of the tank triplet, and the pipe valve 38 in the pipe or conduit 19 is closed, so that loading from the production will take place via the forward valve 20 and filling by means of the pumps will take place via the rearward valve 20. All of the valves 27 are opened, except in the center tank of the tank triplet. By means of the pipe and valve arrangement in the pump room, one, two or three of the unloading pumps 23, 30, 31 may be used to suck/unload from the center tanks 3 except the center tank of the tank triplet, and to fill the tank triplet quickly so that the period for standing waves in the tanks is minimized.

When unloading the ship, one starts with the center tanks, or with a desired center tank. The content of the wing tanks is passed to the center tank or center tanks. The flow to the sucking line becomes effective in that the ship is trimmed somewhat afterward. By means of the shown pipe arrangement the operations can be carried out in a simple and efficient manner.

We claim:

1. A method of offshore oil loading of a tanker (1) comprising a number of center tanks (3) arranged in the longitudinal direction of the vessel, and a number of wing tanks (5, 6) located in pairs on either side of respective center tanks, a loading line (19) being connected to the center tanks (3) via respective values (20), and adjacent center tanks (3) being connected to each other via bulkhead valves (18), comprising the steps of a) firstly effecting filling of a desired number of the center tanks (3), these being substantially narrower and having a correspondingly smaller volume than the wing tanks (5, 6), b) thereafter opening bulkhead valves (17) between a center tank (3) and an appurtenant wing tank pair (5, 6), and sluicing out oil from the center tanks (3) into the two wing tanks (5, 6) by means of the static pressure from the center tanks, the bulkhead valves (18) between the center tanks (3) being open, so that the wing tank pair (5, 6) is filled as quickly as possible by suitable operation of the bulkhead valves (18) between the center tanks (3) and of the valves (20) of the loading line (19) to the center tanks (3), c) closing the bulkhead valves (17) to the two wing tanks (5,6) when these and the appurtenant center tank (3) are filled to a desired level, and d) repeating the filling process according to the steps b) and c) successively for additional wing tank pairs (5, 6) after that all center tanks (3) have been filled again.

2. A method according to claim 1, when loading from an underwater buoy received in a submerged receiving space (9) in the bow portion of the vessel (1), wherein the oil is guided directly from the buoy to said loading line (19), said line extending at bottom level through the center tanks (3) of the vessel.

3. A method according to claim 1, wherein all the center tanks (3) are filled simultaneously during step a), all the bulkhead valves (18) between the center tanks (3) being kept open.

4. A method according to claim 1, wherein the center tanks (3) are filled one by one during step a), the bulkhead valves (18) being kept shut.

5. A method according to claim 1, wherein the valves (20) of the loading line (19) to the center tanks (3), when these have been filled according to step a), thereafter are closed, except to the center tank (3) the wing tank pair (5, 6) of which is to be filled, whereafter the bulkhead valves (17) to the wing tank pair (5, 6) are opened, so that the wing tank pair (5, 6) is filled to a desired level, that the bulkhead valves (18) between all the center tanks (3) thereafter are closed, whereas the valve (20) of the loading line (19) to said center tank (3) is kept open, so that the topical tank triplet (I, II, III, IV, V or VI) is filled quite up to the desired level for transport, and that the valve (20) of the loading line (19) to the center tank (3) is closed when the bulkhead valves (17) to the two wing tanks (5, 6) are closed, at the same time as the valve (20) of the loading line (19) to the next center tank (3) to be filled, is opened.

6. A vessel for offshore oil loading, comprising a number of center tanks (3) arranged in the longitudinal direction of the vessel (1), and a number of wing tanks (5, 6) located in pairs on either side of respective center tanks (3), a loading line (19) being connected to the center tanks via respective valves (20), and adjacent center tanks (3) being connected to each other via bulkhead valves (18), wherein the center tanks (3) have a width which is less than half the width of the wing tanks (5, 6), that all tank triplets (I–VI) consisting of a center tank (3) and an appurtenant wing tank pair (5, 6) are connected to each other via bulkhead valves (17), and that the loading line (19) extends through the center tanks (3), all valves (17, 18, 20) with appurtenant drive units being arranged centrally, in connection with the center tank area, a submerged receiving space (9) being arranged in the bow portion of the vessel (1), for the reception of an adapted underwater buoy, the loading line (19) extending as a bottom line through the center tanks (3), the loading line at its forward end being coupled to equipment (11) for direct connection to the buoy, and at its rearward end being coupled to pumping equipment (23) for unloading purposes.

7. A vessel according to claim 6, comprising a submerged receiving space (9) arranged in the bow portion of the vessel (1), for the reception of an adapted underwater buoy, CHARACTERIZED IN that the loading line (19) extends as a bottom line through the center tanks (3), the loading line at its forward end being coupled to equipment (11) for direct connection to the buoy, and at its rearward end being coupled to pumping equipment (23) for unloading purposes.

8. A vessel according to claim 6, wherein additional conduits (26, 28) are arranged in the center tank area, which conduits extend from pumping equipment (31, 32) at the rearward end of the vessel (1) and forwards to chosen tank groups, with a view to segregation of tank areas, double bulkhead valves (32, 33) being provided between the adjacent center tanks (3) between different segregation areas.

9. A vessel according to claim 6, wherein the wing tanks (5, 6) have a tilted bottom inward towards the center tanks (3).

10. A vessel according to claim 6, wherein the center tanks (3) are provided with transversely extending baffle plates (4).

11. A vessel according to any one of claims 6, 8, 9 or 10, wherein an additional conduit (26) is arranged in the center tank area, which conduit extends from pumping equipment (23, 31, 32) at the rearward end of the vessel (1) forwards to the forward tank triplet (I) and is connected to each of the center tanks (3) via separate valves (27), and which conduit is arranged to cooperate with the loading line (19) to fill the tank triplets successively by means of the pumping equipment.

* * * * *